US011245168B2

(12) United States Patent
Yu

(10) Patent No.: US 11,245,168 B2
(45) Date of Patent: Feb. 8, 2022

(54) FILTER

(71) Applicant: INDUSTRIAL TECHNOLOGY RESEARCH INSTITUTE, Hsinchu (TW)

(72) Inventor: Jiun-Jang Yu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 16/935,144

(22) Filed: Jul. 21, 2020

(65) Prior Publication Data

US 2021/0305669 A1 Sep. 30, 2021

(30) Foreign Application Priority Data

Mar. 30, 2020 (TW) ..... 109110745

(51) Int. Cl.
*H01P 1/203* (2006.01)
*H01P 7/08* (2006.01)
*H01P 3/08* (2006.01)

(52) U.S. Cl.
CPC ..... *H01P 1/20345* (2013.01); *H01P 3/081* (2013.01); *H01P 7/082* (2013.01)

(58) Field of Classification Search
CPC .... H01P 1/20327; H01P 1/20336; H01P 3/08; H01P 3/081; H01P 3/082; H01P 1/20345
USPC ..... 333/204, 205, 238
See application file for complete search history.

(56) References Cited

U.S. PATENT DOCUMENTS 5,376,908 A 12/1994 Kawaguchi et al.
6,483,404 B1 11/2002 Ammar et al.
6,529,750 B1 3/2003 Zhang et al.
7,183,882 B2 2/2007 Ko et al.
(Continued)

FOREIGN PATENT DOCUMENTS

CN 101212076 B 4/2011
CN 102136615 7/2011
(Continued)

OTHER PUBLICATIONS

TW Notice of Allowance in Application No. 109110745 dated Nov. 11, 2020.
(Continued)

*Primary Examiner* — Rakesh B Patel
(74) *Attorney, Agent, or Firm* — Maschoff Brennan

(57) ABSTRACT

The disclosure relates to a filter including dielectric substrate, ground and microstrip line layers, and signal and ground vias. The ground layer is formed on the dielectric substrate and has a ground plane and signal terminal contacts. The microstrip line layer is located on the dielectric substrate and includes microstrip resonators, common electrode and input and output terminal contacts. The input and output terminal contacts are connected to the microstrip resonators. The signal and ground vias extend among the ground layer, the dielectric substrate, and the microstrip line layer. The signal terminal contacts are connected to the input and output terminal contacts through the signal vias. The ground plane is connected to the common electrode through the ground vias. The filter further includes at least one capacitive coupling unit capacitive-coupled with two of the microstrip resonators adjacent to each other.

20 Claims, 7 Drawing Sheets

(56) References Cited

U.S. PATENT DOCUMENTS

| | | | | |
|---|---|---|---|---|
| 7,236,068 | B2 | 6/2007 | Shamsaifar et al. | |
| 7,724,109 | B2 | 5/2010 | Knecht et al. | |
| 7,907,036 | B2 | 3/2011 | Hiroshima et al. | |
| 9,812,750 | B2 | 11/2017 | Randall et al. | |
| 2004/0104790 | A1 | 6/2004 | Nishihara et al. | |
| 2005/0017824 | A1 | 1/2005 | Hirabayashi | |
| 2005/0093661 | A1 | 5/2005 | Gomez et al. | |
| 2009/0085693 | A1 | 4/2009 | Fukunaga | |
| 2010/0164651 | A1* | 7/2010 | Erb | H01P 1/20345 333/204 |
| 2010/0237965 | A1 | 9/2010 | Mi et al. | |
| 2011/0279176 | A1 | 11/2011 | Oran | |

FOREIGN PATENT DOCUMENTS

| | | | |
|---|---|---|---|
| CN | 103378387 | | 10/2013 |
| CN | 107611539 | | 1/2018 |
| EP | 429067 | | 5/1991 |
| JP | S62164301 | A | 7/1987 |
| JP | H06120706 | A | 4/1994 |
| JP | H8-65007 | A | 3/1996 |
| JP | H11-163602 | A | 6/1999 |
| JP | 2000-174501 | A | 6/2000 |
| JP | 2004-120016 | A | 4/2004 |
| JP | 2010-220139 | A | 9/2010 |
| TW | 200522428 | | 7/2005 |
| TW | 200638597 | A | 11/2006 |
| WO | 2009/011168 | A1 | 1/2009 |

OTHER PUBLICATIONS

JP Office Action in Application No. 2020-141731 dated Aug. 17, 2021.
JP NOA in Application No. 2020-141731 dated Dec. 14, 2021.

* cited by examiner

FILTER

CROSS-REFERENCE TO RELATED APPLICATIONS

This non-provisional application claims priority under 35 U.S.C. § 119(a) on Patent Application No(s). 109110745 filed in Taiwan (ROC) on Mar. 30, 2020, the entire contents of which are hereby incorporated by reference.

TECHNICAL FIELD

The disclosure relates to a filter, more particularly to a filter using microstrip technology.

BACKGROUND

As mobile terminals such as smartphones become more and more powerful, it needs to cover as many frequency bands as possible. Radio frequency front-end (RFFE) module is a functional area of a mobile handset between the RF transceiver and the antenna and is critical for wireless communication applications, and therefore its performance determines some important features, such as the communication mode that the mobile terminal can support, the strength of received signal, the wireless communication stability, and the transmission power.

Nowadays, a typical high-end smartphone for international use might need to filter transmission and reception paths of 2G, 3G and 4G modes, cover up to dozens bands and coexisting with Wi-Fi, Bluetooth and GPS system. In addition to the need for substantial isolation between signal pathways to avoid interferences, it is also necessary to suppress other unwanted noise or signals. This leads to a growth in the number of filters within each device. Meanwhile, with the trend of miniaturization, how to miniaturize the device with so many filtering components also become one of the important projects in related fields.

In practical application, a filter may include capacitor, inductor, and resistor implemented in integrated circuit form for ensuring the specific signal propagates into the circuit while noise or other signals that lie outside the desired bandwidth are excluded. In long term evolution (LTE), the surface acoustic wave (SAW) and bulk acoustic wave (BAW) filters may deliver exceptional performance with sharp roll-off, low insertion loss, and high isolation and therefore are widely used.

However, according to reports, in high-frequency applications (e.g., 5G millimeter wave (mmWave) services), the existing SAW and BAW filters, instead of keeping their performance, increase the passband return loss and have poor stopband attenuation. For this reason, with the advent of the 5G era, it is undesirable for the RFFE module to continue to use the SAW and BAW filters as bandwidth filters.

SUMMARY

One embodiment of the disclosure provides a filter including a dielectric substrate, a ground layer, a microstrip line layer, two signal vias and a plurality of ground vias. The ground layer is formed on a surface of the dielectric substrate and has a ground plane and two signal terminal contacts. The microstrip line layer is located on another surface of the dielectric substrate and includes at least three microstrip resonators, a common electrode, an input terminal contact, and an output terminal contact. The input terminal contact and the output terminal contact are respectively connected to two of the at least three microstrip resonators, and the at least three microstrip resonators extend outwards from the common electrode. The signal vias and the ground vias extend among the ground layer, the dielectric substrate, and the microstrip line layer. The signal terminal contacts are respectively connected to the input terminal contact and the output terminal contact through the plurality of signal vias. The ground plane is connected to the common electrode through the plurality of ground vias. The filter further includes at least one capacitive coupling unit capacitive-coupled with two of the at least three microstrip resonators adjacent to each other.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
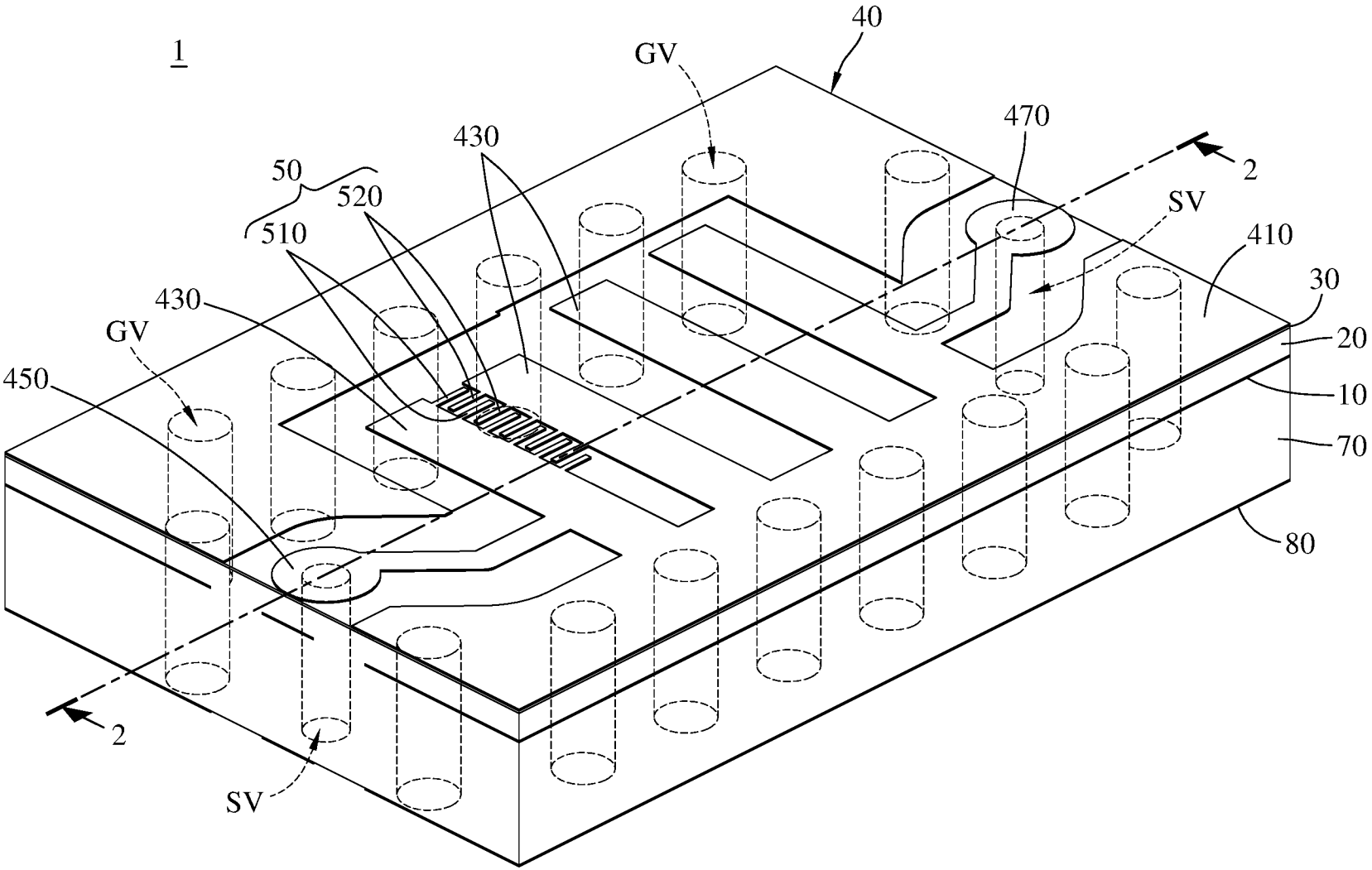
FIG. 1 is a perspective view of a filter according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details.

In addition, for the purpose of simple illustration, well-known features may be drawn schematically, and some unnecessary details may be omitted from the drawings. And the size or ratio of the features in the drawings of the present disclosure may be exaggerated for illustrative purposes, but the present disclosure is not limited thereto. Note that the actual size and designs of the product manufactured based on the teaching of the present disclosure may also be properly modified according to any actual requirement.

Further, as used herein, the terms "end", "part", "portion" or "area" may be used to describe a technical feature on or between component(s), but the technical feature is not limited by these terms. In addition, unless otherwise specified, the term "substantially", "approximately" or "about" may be used herein to provide an industry-accepted tolerance to its corresponding term without resulting in a change in the basic function of the subject matter at issue.

Furthermore, unless otherwise defined, all the terms used in the disclosure, including technical and scientific terms, have their ordinary meanings that can be understood by those skilled in the art. Moreover, the definitions of the above terms are to be interpreted as being consistent with the technical fields related to the disclosure. Unless specifically defined, these terms are not to be construed as too idealistic or formal meanings.

Figure 2:
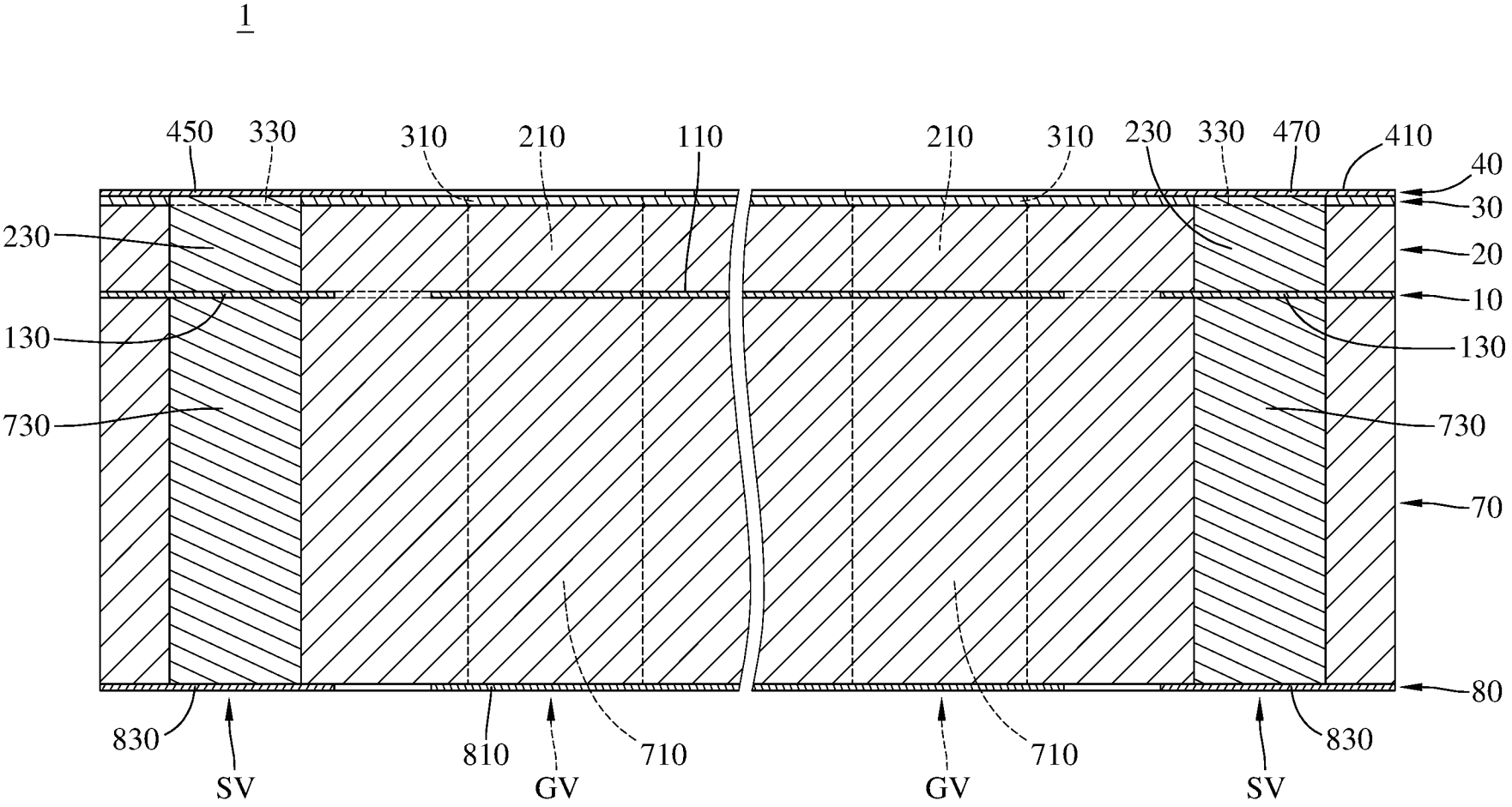
FIG. 2 is a partial enlarged cross-sectional view of the filter taken along line 2-2 in FIG. 1.
Figure 3:
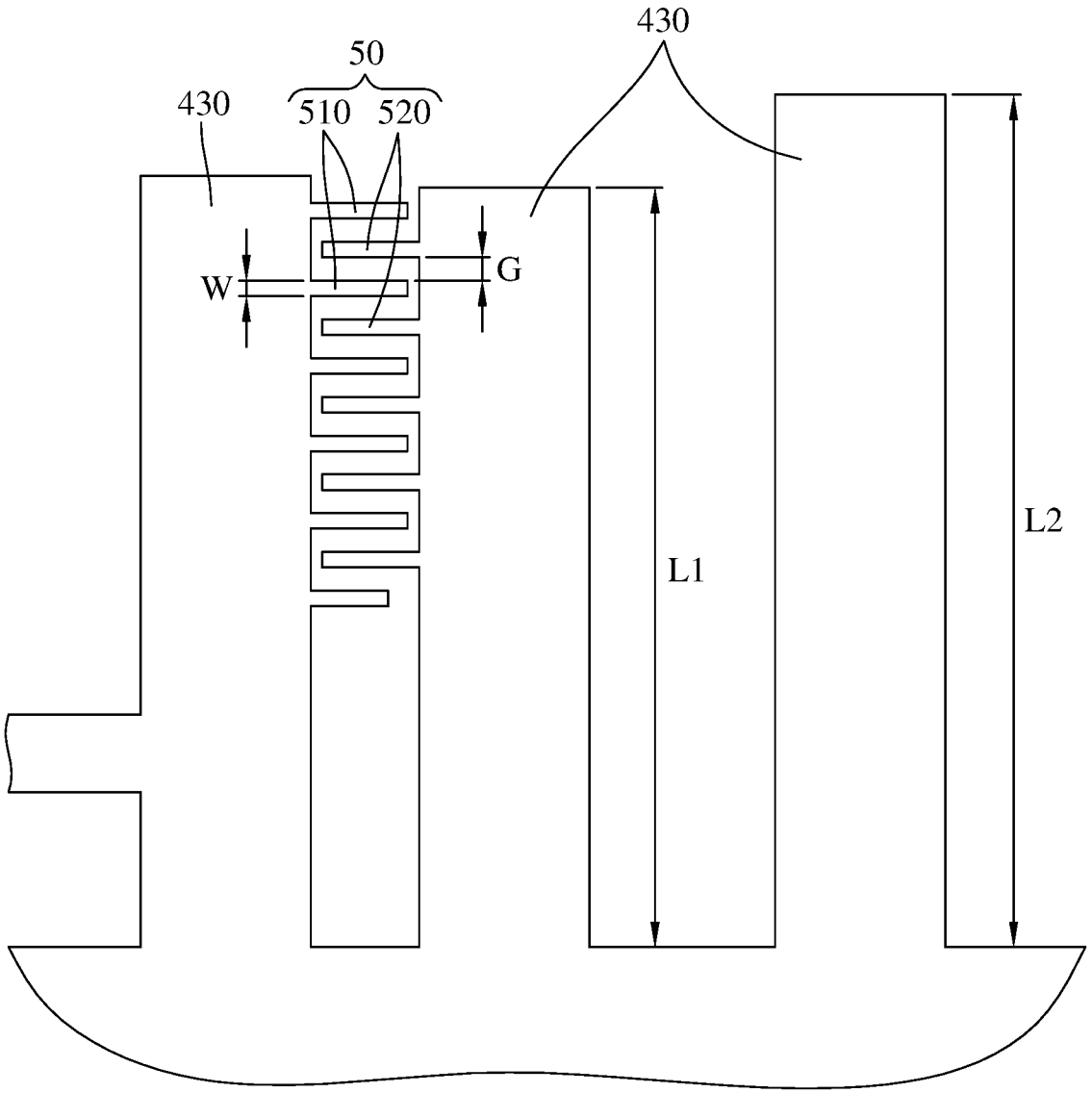
FIG. 3 is a partial enlarged top view of the filer in FIG. 1.

Firstly, referring to FIGS. 1-3, where FIG. 1 is a perspective view of a filter 1 according to one embodiment of the disclosure, FIG. 2 is a partial enlarged cross-sectional view of the filter 1 taken along line 2-2 in FIG. 1, and FIG. 3 is a partial enlarged top view of the filer 1 in FIG. 1. Note that, in these drawings or subsequent drawings, the components in the filter may be illustrated in a proportion and size that for the purpose of ease understanding, but the disclosure is not limited thereto. And it is noted that some of the drawings (e.g., FIG. 3) may only show part of the filter for the purpose of simple illustration.

As shown, in this embodiment, the filter 1 at least includes a ground layer 10, a dielectric substrate 20, a flat layer 30, a microstrip line layer 40, and at least one capacitive coupling unit 50. In addition, the filter 1 may further include a dielectric layer lamination 70 and a ground layer 80. The arrangements of the above components are introduced below.

The ground layer 80 is made of suitable metal (e.g., copper) and the disclosure is not limited thereby. In this embodiment, the ground layer 80 includes a ground plane 810 and two signal terminal contacts 830.

The dielectric layer lamination 70 is formed on the ground layer 80. The dielectric layer lamination 70 is made of, for example, ceramic. For example, the dielectric layer lamination 70 is a structure made from a number of ceramic layers of the same or different thicknesses stacked, aligned, laminated, and fired together using low temperature co-fired ceramic (LTCC) technology. The dielectric layer lamination 70 has a dielectric coefficient ranging approximately between 3 and 20 (larger than 5, for instance).

Note that the thickness or height of the dielectric layer lamination 70 can be modified according to the required structural strength or height of filter, environment conditions, or other actual requirements, and the disclosure is not limited thereby. In addition, the dielectric layer lamination 70 includes a plurality of conductive vias 710 and two conductive vias 730 penetrating therethrough, wherein the conductive vias 710 are connected to the ground plane 810 of the ground layer 80, and the conductive vias 730 are respectively connected to the signal terminal contacts 830 of the ground layer 80.

The ground layer 10 is formed on another surface of the dielectric layer lamination 70 facing away from the ground layer 80. The ground layer 10 may have the same or similar configuration to that of the ground layer 80 and is also made of suitable metal. In this embodiment, the ground layer 10 includes a ground plane 110 and two signal terminal contacts 130, wherein the ground plane 110 is connected to the conductive vias 710 of the dielectric layer lamination 70, and the signal terminal contacts 130 are respectively connected to the conductive vias 730 of the dielectric layer lamination 70.

The dielectric substrate 20 is formed on a surface of the ground layer 10 facing away from the dielectric layer lamination 70. Similar to the dielectric layer lamination 70, the dielectric substrate 20 is also made using low temperature co-fired ceramic technology. The dielectric substrate 20 has a dielectric coefficient ranging approximately between 3 and 20 (larger than 5, for instance).

Note that the thickness or height of the dielectric substrate 20 is not particularly restricted but is preferably as small as possible for the purpose of filter miniaturization. For example, the dielectric substrate 20 may be a single layer of raw material of LTCCs having the possible minimum thickness. Thus, as shown, the dielectric substrate 20 has a thickness apparently smaller than that of the dielectric layer lamination 70. In one example, the dielectric substrate 20 has a thickness of less than 150 μm (e.g., 125 μm), but the disclosure is not limited to.

In addition, the dielectric substrate 20 includes a plurality of conductive vias 210 and two conductive vias 230 penetrating therethrough, wherein the conductive vias 210 are connected to the ground plane 110 of the ground layer 10, and the conductive vias 230 are respectively connected to the signal terminal contacts 130 of the ground layer 10.

The flat layer 30 is formed on a surface of the dielectric substrate 20 facing away from the ground layer 10. In other words, the dielectric substrate 20 is located between the flat layer 30 and the ground layer 10. The flat layer 30 and the dielectric substrate 20 are different in material. The flat layer 30 is made from, for example, Epoxy, Polyimide (PI), or glass; specifically, the flat layer 30 is made from, for example, light-sensitive material that can be used in photolithography process.

The flat layer 30 has a thickness ranging, for example, approximately between 3 and 20 μm. While forming the flat layer 30, the flat layer 30 can fill in all the holes on the surface of the dielectric substrate 20 caused by the manufacturing factors, such that the flat layer 30 is able to create a flat surface with a high degree of flatness on the dielectric substrate 20. In addition, the flat layer 30 includes a plurality of conductive vias 310 and two conductive vias 330 penetrating therethrough, wherein the conductive vias 310 are connected to the conductive vias 210 of the dielectric substrate 20, and the conductive vias 330 are respectively connected to the conductive vias 230 of the dielectric substrate 20.

The microstrip line layer 40 is formed on a surface of the flat layer 30 facing away from the dielectric substrate 20, in other words, the flat layer 30 is located between the microstrip line layer 40 and the dielectric substrate 20. Since the flat layer 30 has a high degree of flatness, it is allowed to use photolithography process to form the microstrip line layer 40 onto the flat layer 30, and this process can make the microstrip line layer 40 only have a thickness of approximately 15 μm. And the flatness of the flat layer 30 can make the microstrip line layer 40 more firmly attach to the flat layer 30. Also, the microstrip line layer 40 made using photolithography would have a very low roughness. As such, the bottom and top surfaces of the microstrip line layer 40 will have a high degree of flatness and low degree of roughness and therefore beneficial to reduce the loss in passband.

On the contrary, in the case without the flat layer 30, a microstrip line layer shall be directly formed on the dielectric substrate 20, but the holes and rough surface of the dielectric substrate 20 make it difficult or impossible to use photolithography to form the microstrip line layer, and thus the dielectric substrate 20 can only be made using grid printing. This affects the flatness of the microstrip line layer and increases the roughness of the microstrip line layer and thereby leading increase in passband insertion loss. Also, while directly forming the microstrip line layer on the dielectric substrate 20, the material of the microstrip line layer would easily diffuse into the holes of the dielectric substrate 20 so that the microstrip resonators are unable to be formed into the desired shape.

Referring back to FIG. 2, the microstrip line layer 40 and the flat layer 30 are relatively thin and can be considered as a thin layer (film) compared to other relatively thick layers (film) (i.e., the dielectric substrate 20 and the dielectric layer lamination 70). In such an arrangement, the filter 1 is implemented as a stack of thin and thick layers (films). Similar to this concept, referring to the part above the ground layer 10, the stack of the microstrip line layer 40 and the flat layer 30 also can be considered as a thin layer (film) compared to the dielectric substrate 20, that is, the dielectric substrate 20 can be considered as a thick layer (film) compared to the microstrip line layer 40 and the flat layer 30. Thus, there is also a stack of thin and thick layers existing on the ground layer 10.

Then, in this embodiment, the microstrip line layer 40 includes a common electrode 410, at least three microstrip resonators 430, an input terminal contact 450, and an output terminal contact 470. The common electrode 410 is connected to the conductive vias 310 of the flat layer 30, and the input terminal contact 450 and the output terminal contact 470 are respectively connected to two of the microstrip resonators 430 and are respectively connected to the conductive vias 330 of the flat layer 30. As shown, in this embodiment, the common electrode 410 of the microstrip line layer 40, the conductive vias 310 of the flat layer 30, the conductive vias 210 of the dielectric substrate 20, the ground plane 110 of the ground layer 10, the conductive vias 710 of the dielectric layer lamination 70, and the ground plane 810 of the ground layer 80 together form a plurality of ground vias GV in the filter 1, such that the common electrode 410 of the microstrip line layer 40 can be connected to the ground plane 810 of the ground layer 80 through the ground vias GV. The input terminal contact 450 and the output terminal contact 470 of the microstrip line layer 40, the conductive vias 330 of the flat layer 30, the conductive vias 230 of the dielectric substrate 20, the signal terminal contacts 130 of the ground layer 10, the conductive vias 730 of the dielectric layer lamination 70, and the signal terminal contacts 830 of the ground layer 80 together form two signal vias SV in the filter 1, such that the input terminal contact 450 and the output terminal contact 470 of the microstrip line layer 40 can be in signal communication with the signal terminal contacts 830 of the ground layer 80 through the signal vias SV.

The microstrip resonators 430 are connected to the common electrode 410 and extend outwards from the common electrode 410 and therefore each have a free end. The microstrip resonators 430 are spaced to be arranged in a combline arrangement.

Herein, the dielectric substrate 20 underneath the microstrip line layer 40 may be implemented by a single LTCC layer with possible minimum thickness, thus the microstrip resonators 430 of the microstrip line layer 40 are allowed to be spaced by a relatively small distance still sufficient for signal transmission. In addition, the high dielectric coefficient of the dielectric substrate 20 allows the microstrip resonators 430 to have a short length still sufficient for the stack of thin and thick layers (the microstrip line layer 40 and the dielectric substrate 2) to achieve the desired resonance effect. As such, with the relatively small thickness and high dielectric coefficient of the dielectric substrate 20, the microstrip resonators 430 of the microstrip line layer 40 can have a short length and be spaced by a small distance, which helps reduce the overall size to meet the requirement of miniaturization.

In this embodiment, the capacitive coupling unit 50 is capacitive-coupled with the two of the microstrip resonators 430 located adjacent to each other. Specifically, the capacitive coupling unit 50 includes a plurality of first fingers 510 and a plurality of second fingers 520, the first fingers 510 are integrally formed with one of the microstrip resonators 430, the second fingers 520 are integrally formed with another one of the microstrip resonators 430. In more detail, the first fingers 510 extend from one of the microstrip resonators 430 towards another adjacent microstrip resonator 430 and are spaced along the microstrip resonator 430 they are connected to, the second fingers 520 extend from the another microstrip resonator 430 towards the microstrip resonator 430 where the first fingers 510 are located and are spaced along the microstrip resonator 430 they are connected to.

As shown, the first fingers 510 and the second fingers 520 located between two adjacent microstrip resonators 430 are alternately interlaced with each other to form an interdigital capacitor. In this embodiment, the first fingers 510, the second fingers 520, and the microstrip resonators 430 are all formed on the surface of the flat layer 30 facing away from the dielectric substrate 20, In short, in this embodiment, the capacitive coupling unit 50 and the microstrip line layer 40 are formed on the same plane and can be considered as the same layer.

In the capacitive coupling unit 50, the first fingers 510, and the second fingers 520 may each have a width W at least less than approximately 50 μm (e.g., approximately 10 μm) and may be spaced by a gap G at least less than approximately 50 μm (e.g., approximately 10 μm). This ensures the forming of the capacitive coupling of the first fingers 510 and the second fingers 520 between the adjacent microstrip resonators 430.

Figure 4:
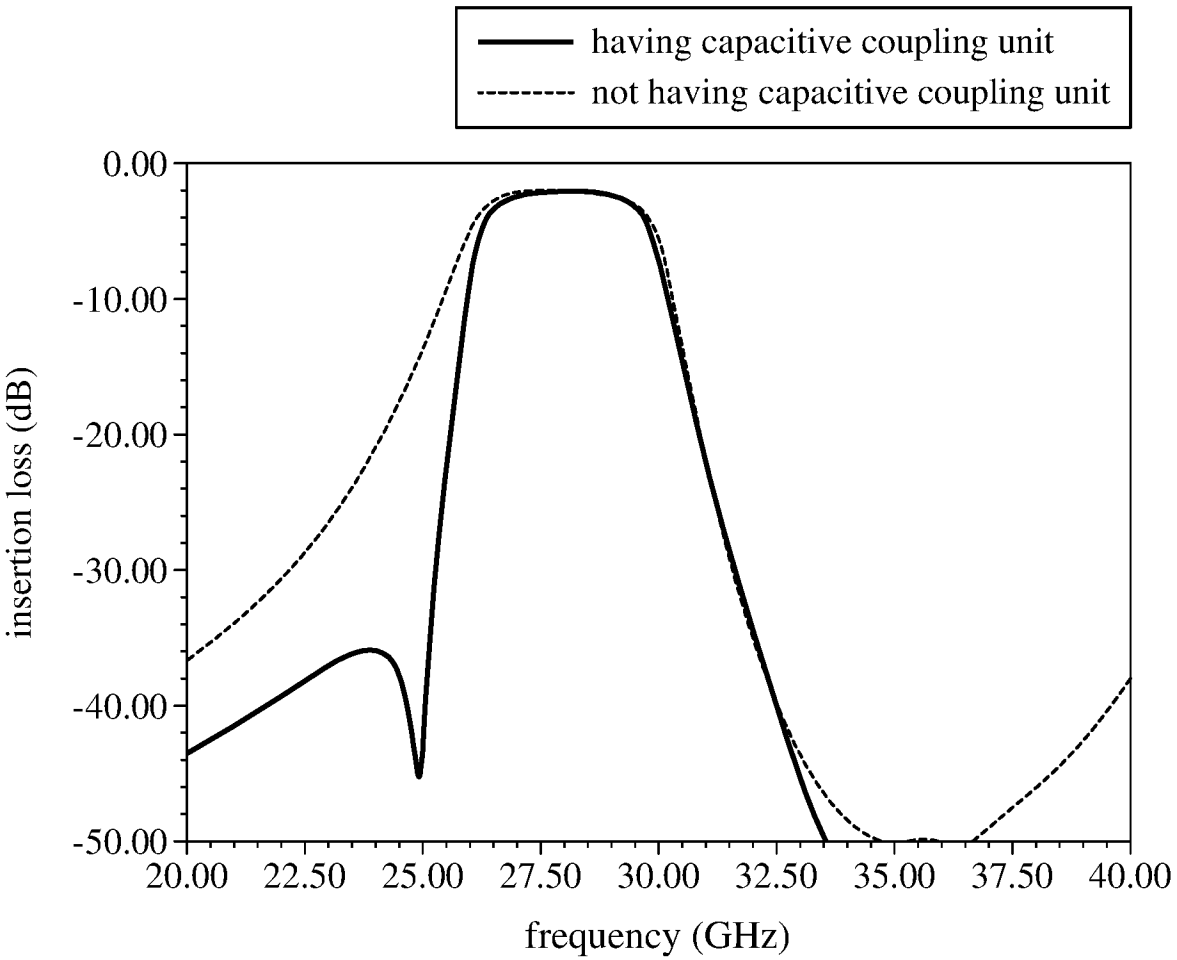
FIG. 4 is a comparison of simulated frequency responses of the filter in FIG. 1 and a filter without the capacitive coupling unit.

Then, please refer to FIG. 4, there is shown a comparison of simulated frequency responses of the filter 1 and a filter without the capacitive coupling unit 50, wherein the solid line represents the characteristics of the filter 1 having the capacitive coupling unit 50 while the dashed line represents the characteristics of the filter 1 with the removal of the capacitive coupling unit 50. As shown, in millimeter-wave applications, the capacitive coupling effect contributed by the capacitive coupling unit 50 can exhibit an obvious transmission zero and thus having a great improvement in stopband suppression.

In addition, as shown, in this or some other embodiments, the adjacent microstrip resonators 430 having the capacitive coupling unit 50 have a length L1 (the length of the long side from the root connected to the common electrode 410 to the distal end thereof) at least shorter than a length L2 of other microstrip resonators 430. And the length differences among the microstrip resonators 430 help to improve the passband performance of the filter 1.

Figure 5:
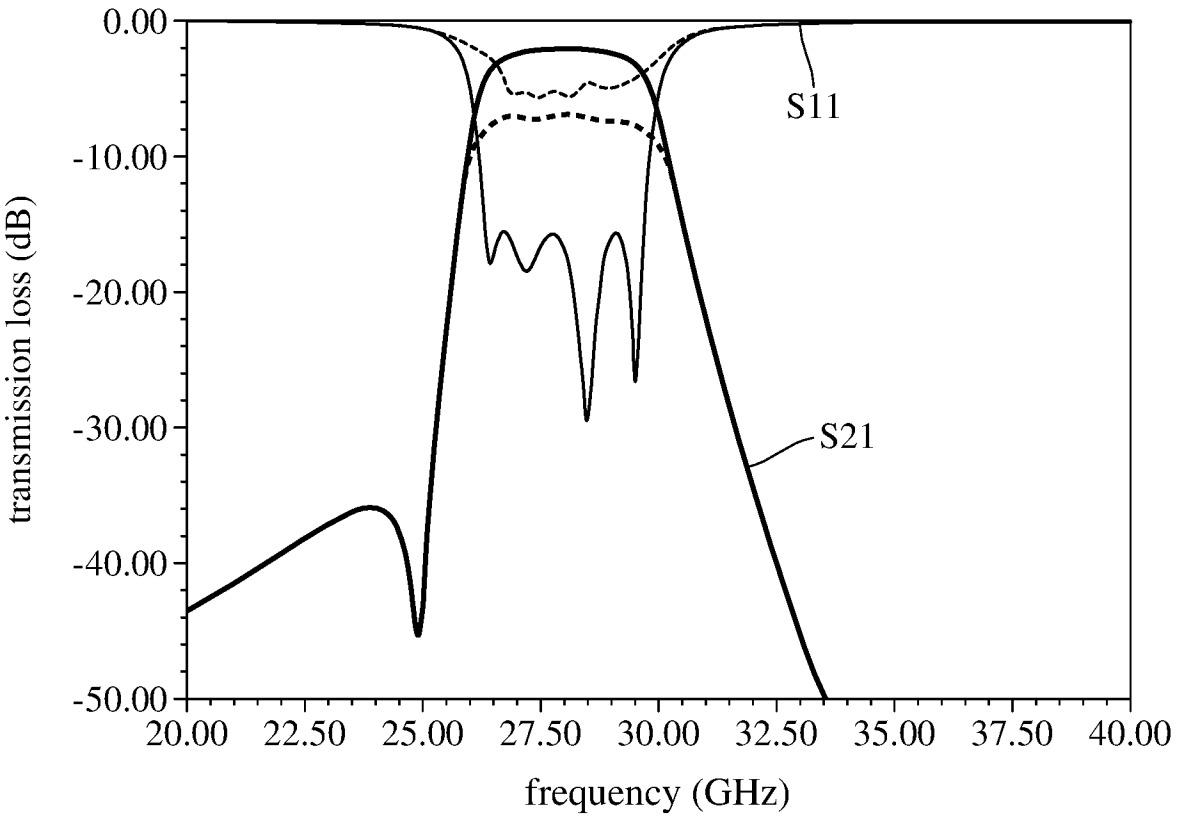
FIG. 5 is a simulated frequency response of the filter in FIG. 1 showing the detail of insertion loss and return loss.

Herein, please refer to FIG. 5, there is shown a simulated frequency response of the filter 1. The thick lines are S11 meaning return loss, and the thin lines are S21 meaning insertion loss, where solid lines reflect the characteristics of the microstrip resonators 430 having the arrangement of length L1 shorter than length L2, and dashed lines reflect the characteristics of the microstrip resonators 430 having the arrangement of length L1 equal to length L2. As shown, the arrangement of having length L1 shorter than length L2 can help to improve the performance of S11 and S21 in passband.

It is noted that the adjacent microstrip resonators 430 having the capacitive coupling unit 50 may have the same or different lengths, and the disclosure is not limited thereto.

Figure 6:
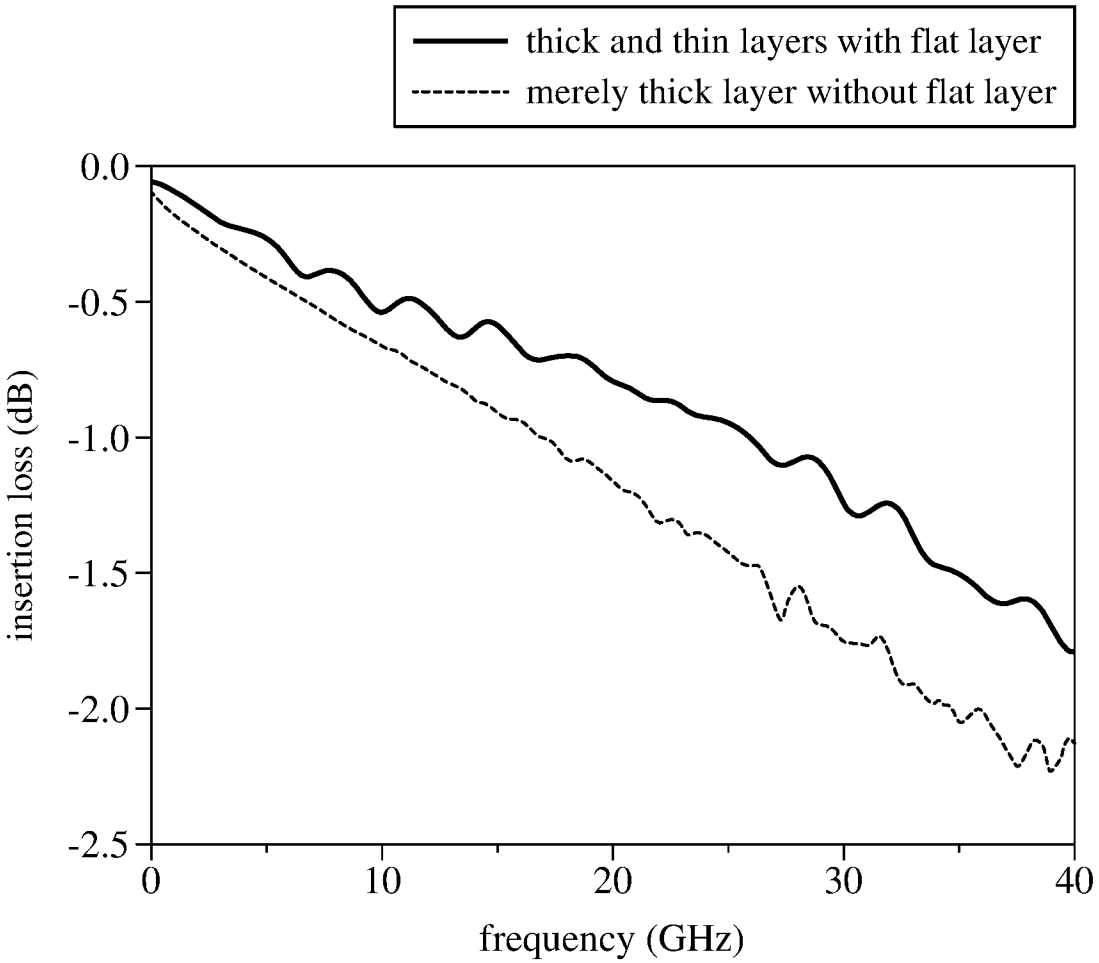
FIG. 6 is an insertion loss comparison chart regarding a stack of thick and thin layers and a form of merely having thick layer.

Then, please refer to FIG. 6, there is shown an insertion loss comparison chart regarding a transmission line on a stack of thick and thin layers and the same on a form of merely having thick layer, wherein the solid line represents the insertion loss of a transmission line disposed on the flat layer 30 in the stack of thick and thin layers; the dashed line represents the insertion loss of a transmission line disposed on a form of merely having thick layer without the aforementioned flat layer 30 so that its resonator can only be formed on the dielectric substrate using grid printing. In comparison, the existence of the flat layer 30 ensures the high degree of flatness of the bottom and top surfaces of the microstrip line layer 40 and therefore achieves a low transmission loss.

Figure 7:
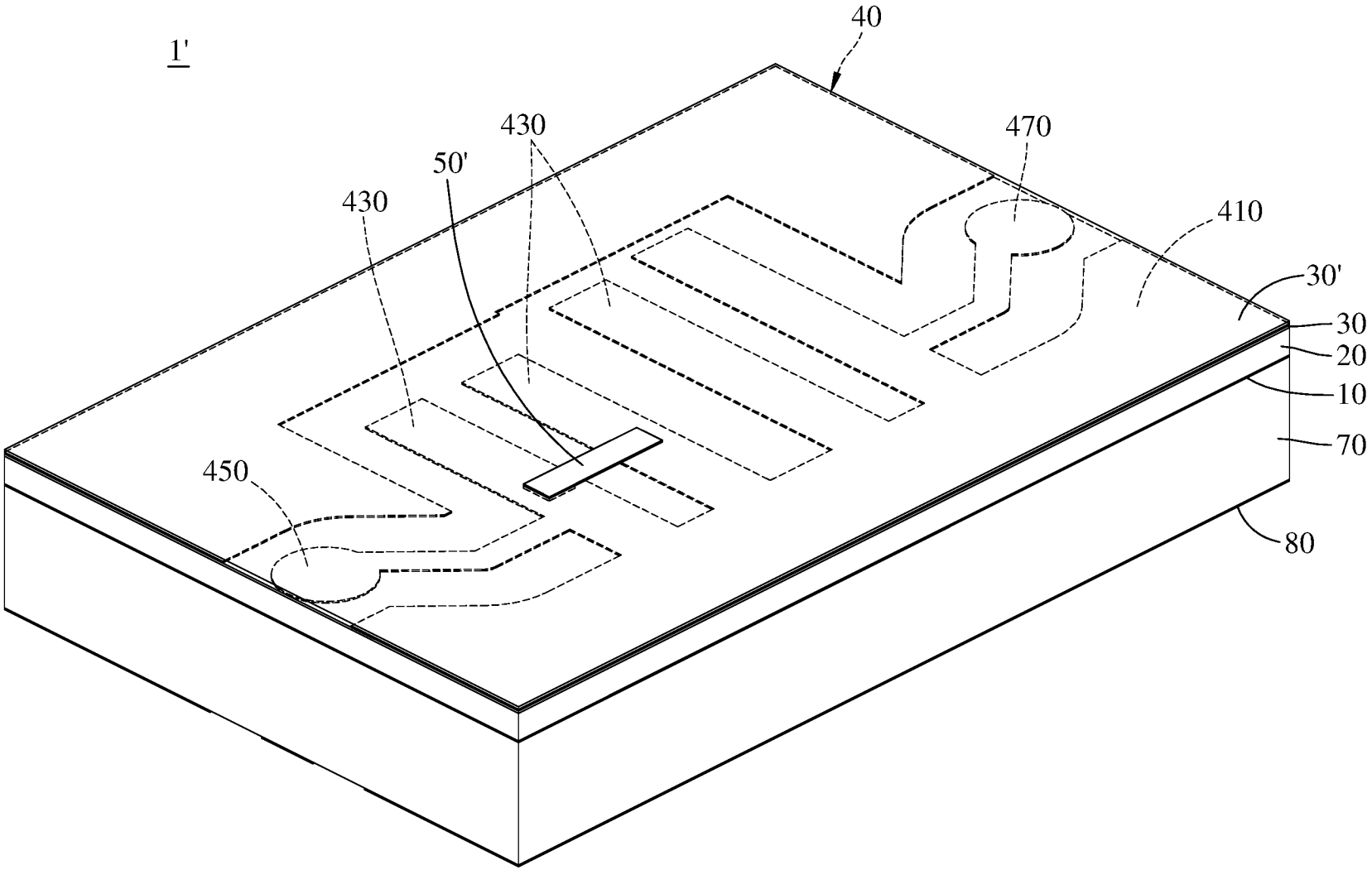
FIG. 7 is a perspective view of a filter according to another embodiment of the disclosure.

In the previous embodiments, the capacitive coupling unit 50 and the microstrip resonators 430 are formed on the same plane and can be considered as the same layer, but the discourse is not limited thereto. For example, referring to FIG. 7, there is shown a perspective view of a filter 1' according to another embodiment of the disclosure, where the main difference between the filter 1' and the filter 1 in the previous embodiments is the location of the capacitive coupling unit, thus only the main difference between these embodiments will be described in the following paragraphs, the same or similar parts can be comprehended with reference to the aforementioned descriptions, and the same or similar components may be numbered the same number.

In this embodiment, the filter 1' includes a capacitive coupling unit 50' being a single-layered capacitor arranged on another plane different from the microstrip line layer 40. Specifically, in this embodiment, the top surface of the microstrip line layer 40 is formed with another flat layer 30' having the configuration substantially the same as that of the aforementioned flat layer 30, and the surface of the flat layer 30' facing away from the microstrip line layer 40 is coated with a layer of capacitor, i.e., the capacitive coupling unit 50'. In this arrangement, the flat layer 30' is located between the microstrip line layer 40 and the capacitive coupling unit 50', and the capacitive coupling unit 50' is arranged crossing two adjacent microstrip resonators 430 of the microstrip line layer 40. Viewing from the top view of the filter 1', the capacitive coupling unit 50' at least overlaps with two adjacent microstrip resonators 430 of the microstrip line layer 40. According to an experiment result, the capacitive coupling unit 50' can be capacitive-coupled with the adjacent microstrip resonators 430, achieving an improvement in stopband suppression equivalent to that of the aforementioned filter. Similarly, in this embodiment, the microstrip resonators 430 that are capacitive-coupled with the capacitive coupling unit 50' may have a length shorter than that of other microstrip resonators 430.

Further, please be noted that, in other embodiments, the filter may have more than one capacitive coupling unit of any one of the previous embodiments, and the capacitive coupling units may be arranged between consecutive adjacent microstrip resonators or between some inconsecutive pairs of adjacent microstrip resonators. In addition, as long as it can achieve the effect similar to that by the capacitive coupling unit and microstrip resonators, the quantities, shapes of the capacitive coupling unit and the locations of the capacitive coupling unit relative to the microstrip resonators all can be modified according to actual requirements, such as character of transmission zero. It is also noted that the quantity of the microstrip resonators may be modified according to actual requirements; in some other embodiments, the filter may have three or more than four microstrip resonators.

According to the filter as discussed in the above embodiments, the capacitive coupling unit is capacitive-coupled with the adjacent microstrip resonators, thus, in mmWave applications, the filter is able to realize a low passband insertion loss and high stopband suppression compared to the traditional SAW and BAW filters. Thus, the filter of the disclosure is more suitable for high-frequency applications.

In addition, due to the flat layer, the microstrip line layer can be formed on a flat surface with a high degree of flatness, which not only can make the microstrip line layer firmly attached to the flat layer but also allows using photolithography to form the microstrip line layer, thereby further improving the overall flatness and therefore reducing the transmission loss.

Further, the microstrip resonators of the filter of the disclosure are short in length and spaced by small gap, which helps reduce the overall size to meet the requirement of miniaturization.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A filter, comprising:

a dielectric substrate;

a ground layer, formed on a surface of the dielectric substrate and having a ground plane and two signal terminal contacts;

a microstrip line layer, located on another surface of the dielectric substrate and comprising at least three microstrip resonators, a common electrode, an input terminal contact, and an output terminal contact, wherein the input terminal contact and the output terminal contact are respectively connected to two of the at least three microstrip resonators, and the at least three microstrip resonators extend outwards from the common electrode; and two signal vias and a plurality of ground vias, extending among the ground layer, the dielectric substrate, and the microstrip line layer, the plurality of signal terminal contacts respectively connected to the input terminal contact and the output terminal contact through the two signal vias, and the ground plane connected to the common electrode through the plurality of ground vias;

wherein the filter further comprises at least one capacitive coupling unit capacitive-coupled with two of the at least three microstrip resonators adjacent to each other;

wherein the microstrip line layer is only capacitive-coupled with one capacitive coupling unit through two of the at least three microstrip resonators adjacent to each other.

2. The filter according to claim 1, wherein the at least one capacitive coupling unit is located between two of the at least three microstrip resonators adjacent to each other.

3. The filter according to claim 1, further comprising a flat layer located between the dielectric substrate and the microstrip line layer, the plurality of signal vias and the plurality of ground vias penetrate through the flat layer, and the flat layer and the dielectric substrate are different in material.

4. The filter according to claim 3, wherein a material of the flat layer comprises Epoxy, Polyimide (PI), or glass.

5. The filter according to claim 1, wherein the at least one capacitive coupling unit comprises a plurality of first fingers and a plurality of second fingers, the plurality of first fingers and the plurality of second fingers are alternately interlaced with each other to form an interdigital capacitor.

6. The filter according to claim 5, wherein the plurality of first fingers and the plurality of second fingers are spaced by a gap at least less than approximately 50 μm.

7. The filter according to claim 5, wherein the plurality of first fingers and the plurality of second fingers each have a width at least less than approximately 50 μm.

8. The filter according to claim 5, wherein the plurality of first fingers are integrally formed with one of the at least three microstrip resonators, the plurality of second fingers are integrally formed with another one of the at least three microstrip resonators, and the plurality of first fingers, the plurality of second fingers, and the at least three microstrip resonators are located on a same plane.

9. The filter according to claim 1, comprising another flat layer located between the microstrip line layer and the at least one capacitive coupling unit, wherein the at least one capacitive coupling unit crosses two of the at least three microstrip resonators located adjacent to each other.

10. The filter according to claim 9, wherein two of the at least three microstrip resonators being crossed by the at least one capacitive coupling unit are shorter than another of the at least three microstrip resonators not crossed by the at least one capacitive coupling unit.

11. A filter, comprising:

a dielectric substrate;

a ground layer, formed on a surface of the dielectric substrate and having a ground plane and two signal terminal contacts;

a microstrip line layer, located on another surface of the dielectric substrate and comprising at least three microstrip resonators, a common electrode, an input terminal contact, and an output terminal contact, wherein the input terminal contact and the output terminal contact are respectively connected to two of the at least three microstrip resonators, and the at least three microstrip resonators extend outwards from the common electrode; and two signal vias and a plurality of ground vias, extending among the ground layer, the dielectric substrate, and the microstrip line layer, the plurality of signal terminal contacts respectively connected to the input terminal contact and the output terminal contact through the two signal vias, and the ground plane connected to the common electrode through the plurality of ground vias;

wherein the filter further comprises at least one capacitive coupling unit capacitive-coupled with two of the at least three microstrip resonators adjacent to each other, and two of the at least three microstrip resonators connected to the at least one capacitive coupling unit are shorter than another of the at least three microstrip resonators not connected to the at least one capacitive coupling unit.

12. The filter according to claim 11, further comprising a flat layer located between the dielectric substrate and the microstrip line layer, the plurality of signal vias and the plurality of ground vias penetrate through the flat layer, and the flat layer and the dielectric substrate are different in material.

13. The filter according to claim 11, wherein the at least one capacitive coupling unit is located between two of the at least three microstrip resonators adjacent to each other.

14. The filter according to claim 13, wherein a material of the flat layer comprises Epoxy, Polyimide (PI), or glass.

15. The filter according to claim 11, wherein the at least one capacitive coupling unit comprises a plurality of first fingers and a plurality of second fingers, the plurality of first fingers and the plurality of second fingers are alternately interlaced with each other to form an interdigital capacitor.

16. The filter according to claim 15, wherein the plurality of first fingers are integrally formed with one of the at least three microstrip resonators, the plurality of second fingers are integrally formed with another one of the at least three microstrip resonators, and the plurality of first fingers, the plurality of second fingers, and the at least three microstrip resonators are located on a same plane.

17. The filter according to claim 15, wherein the plurality of first fingers and the plurality of second fingers are spaced by a gap at least less than approximately 50 μm.

18. The filter according to claim 15, wherein the plurality of first fingers and the plurality of second fingers each have a width at least less than approximately 50 μm.

19. The filter according to claim 11, comprising another flat layer located between the microstrip line layer and the at least one capacitive coupling unit, wherein the at least one capacitive coupling unit crosses two of the at least three microstrip resonators located adjacent to each other.

20. The filter according to claim 19, wherein two of the at least three microstrip resonators being crossed by the at least one capacitive coupling unit are shorter than another of the at least three microstrip resonators not crossed by the at least one capacitive coupling unit.

* * * * *